US006112382A

United States Patent [19]

Parker et al.

[11] Patent Number: 6,112,382

[45] Date of Patent: Sep. 5, 2000

[54] COMBINATION LAWN/GARDEN ORNAMENT AND CREMATION CONTAINER

[75] Inventors: Daniel J. Parker, Connersville, Ind.; Mark H. Thesken, Cincinnati, Ohio

[73] Assignee: Batesville Services, Inc., Batesville, Ind.

[21] Appl. No.: 09/295,557

[22] Filed: Apr. 21, 1999

Related U.S. Application Data

[62] Division of application No. 08/797,413, Feb. 10, 1997, Pat. No. 5,903,961.

[51] Int. Cl.[7] ..... A61G 17/00

[52] U.S. Cl. ..... 27/1; 84/404

[58] Field of Search ..... 27/1; 84/404

[56] References Cited

U.S. PATENT DOCUMENTS

| | | | |
|---|---|---|---|
| D. 085,087 | 9/1931 | Clark . | |
| D. 087,176 | 6/1932 | Treiber . | |
| D. 169,347 | 4/1953 | Woodward . | |
| D. 201,132 | 5/1965 | Lawrence . | |
| D. 268,374 | 3/1983 | Dercks et al. . | |
| D. 344,839 | 3/1994 | May et al. . | |
| D. 345,848 | 4/1994 | May et al. . | |
| D. 356,421 | 3/1995 | Parker . | |
| D. 356,422 | 3/1995 | Parker . | |
| D. 360,732 | 7/1995 | Parker . | |
| D. 370,766 | 6/1996 | Parker . | |
| D. 370,767 | 6/1996 | Parker . | |
| D. 370,768 | 6/1996 | Parker . | |
| D. 398,132 | 9/1998 | Thesken . | |
| 1,940,771 | 12/1933 | Prier . | |
| 2,075,859 | 4/1937 | Martin . | |
| 2,777,233 | 1/1957 | Brandhorst . | |
| 4,324,026 | 4/1982 | Craft . | |
| 4,648,162 | 3/1987 | Diano . | |
| 4,854,214 | 8/1989 | Lowe | 84/404 |
| 4,977,652 | 12/1990 | Graham . | |
| 5,029,373 | 7/1991 | Raymond . | |
| 5,197,603 | 3/1993 | Lundberg . | |
| 5,208,957 | 5/1993 | Hereford . | |
| 5,230,127 | 7/1993 | Zukowski et al. . | |
| 5,287,603 | 2/1994 | Schorman . | |
| 5,647,108 | 7/1997 | Crook | 27/1 |
| 5,648,624 | 7/1997 | Smith | 84/404 |
| 5,729,921 | 3/1998 | Rojas | 27/1 X |
| 5,744,736 | 4/1998 | Chang | 84/404 X |
| 5,815,897 | 10/1998 | Longstreth | 27/1 |

OTHER PUBLICATIONS

Unknown, Planter Box, grey, two leaves, 1 page, date unknown.

Unknown, Planter Box, brown, two leaves, 1 page, date unknown.

Unknown, Wall Fountain, 1 page, date unknown.

Woodstock Chimes, *Instruments of Nature*, 20 pages, ©1996.

(List continued on next page.)

*Primary Examiner*—Terry Lee Melius
*Assistant Examiner*—William L. Miller
*Attorney, Agent, or Firm*—Wood, Herron & Evans, L.L.P.

[57] ABSTRACT

A combination lawn/garden ornament and cremation container comprises a decorative structure adapted to be displayed outdoors on a lawn or in a garden of a loved one of a deceased and an openable and closable compartment adapted to contain cremated remains of the deceased. In one embodiment the combination comprises a hollow pedestal upon which is mounted a sundial, and a tube positioned within the pedestal with a cap removably secured on an end thereof. In another embodiment the combination comprises a stepping stone, a portion of which is adapted to be displayed above a ground surface, and a container, integral with the stepping stone, extending downwardly from a lower surface thereof, and a cover removably secured to the container. In yet another embodiment the combination comprises a planter box and a container forming a part of the planter box and a cover removably secured to the container. In still another embodiment the combination comprises a wind chime assembly including a plurality of chimes and a container forming either a part of an upper support from which the chimes are suspended or a part of a chime motion inducing pendulum of the assembly.

5 Claims, 3 Drawing Sheets

OTHER PUBLICATIONS

Woodstock Chimes, *Instruments of Nature*, 6 pages, ©1995.
Woodstock Chimes, *Presenting six new ways to go around the world of music*, 6 pages, ©1997.
Virginia Metalcrafters, *Catalog*, 10 pages, ©1994.
Unknown, *Planter Box*, grey, two leaves, 1 page, (Date Unknown).
Unknown, *Planter Box*, brown, two leaves, 1 page, (Date Unknown).
Unknown, *Wall Fountain*, 1 page, (Date Unknown).
Virginia Metalcrafters, *Catalog*, Latticework Wall Fountain, 1 page, Spring 1996.
DiscountUrns.com Inc., Pet Sundial Cremation Urn, 2 web site screen print–outs, ©1998–1999.

COMBINATION LAWN/GARDEN ORNAMENT AND CREMATION CONTAINER

This is a divisional of application Ser. No. 08/797,413, filed Feb. 10, 1997, now U.S. Pat. No. 5,903,961.

FIELD OF THE INVENTION

This invention relates generally to funeral products, and more particularly to cremation containers for displaying cremated human remains contained therein.

BACKGROUND OF THE INVENTION

Cremation is a growing segment of the funeral industry. Consequently, there is an increasing demand for more and higher quality styles and designs of cremation containers.

One popular design theme for cremation urns is the outdoor/animal theme. Five such designs are disclosed in U.S. Pat. Nos. Des. 356,421, 370,767, 370,766 and 370,768, and U.S. patent application Ser. No. 08/733,882, all of which are assigned to the assignee of the present invention and are hereby incorporated by reference herein as if fully set forth in their entirety.

Other, more traditional styles of cremation urns are disclosed in, for example, U.S. Pat. Nos. Des. 344,839, 345, 848, 356,422 and 360,732, all of which are assigned to the assignee of the present invention and are hereby incorporated by reference herein as if fully set forth in their entirety.

All of the above-described cremation containers are adapted to be displayed in the residence of a loved one of the deceased, for example, on a fireplace mantel, coffee table, end table or the like.

There is a continuing need for attractive, yet somewhat non-traditional, progressive or alternative, means for displaying the cremated remains of a deceased by a loved one wishing to memorialize the past life of the deceased.

Accordingly, it is a main objective of the present invention to provide an alternative means of displaying the cremated remains of a deceased for memorial purposes by a loved one of the deceased which is in contrast to the more traditional types of cremation containers presently in display.

SUMMARY OF THE INVENTION

In accordance with the stated objective, the present invention is a combination lawn/garden ornament and cremation container. The combination lawn/garden ornament and cremation container comprises a decorative structure adapted to be displayed outdoors on a lawn or in a garden of a loved one of a deceased, and an openable and closable compartment adapted to contain cremated remains of the deceased.

In one embodiment of the present invention, the decorative structure comprises a hollow pedestal upon which is mounted a sundial. The openable and closable compartment comprises a tube positioned within the hollow pedestal with a cap removably secured on an end thereof. The tube is preferably fabricated of plastic and includes a flange at a lower end thereof. The flange is secured to a base portion of the pedestal with fasteners, and the cap is removably secured to an upper end of the tube. The cap is preferably a press-fit on the upper end of the tube. The sundial preferably includes an upwardly oriented face thereon including a personalized inscription thereon memorializing the deceased.

In another embodiment of the present invention, the decorative structure comprises a stepping stone, a portion of which is adapted to be displayed above a ground surface. The openable and closable compartment comprises a container, integral with the stepping stone, and extending downwardly from a lower surface thereof, and a cover removably secured to the container, the container being adapted to be positioned below a ground surface. The stepping stone and container are preferably fabricated of concrete and the stepping stone includes a stained glass inlay on an upper surface thereof. The stepping stone further preferably includes a central region on the upper surface including a personalized inscription thereon memorializing the deceased. The cover may be removably secured to a lower end of the container, or alternatively, may be removably secured to a lateral side of the container.

In yet another embodiment the decorative structure comprises a planter box. The openable and closable compartment comprises a container forming a part of the planter box and a cover removably secured to the container. The container may be formed in a bottom of the planter box, with the cover being removable from a lower side thereof; alternatively, the container may be formed in a side of the planter box, with the cover being removable from an upper side thereof. In the case of the latter, the container upper edge is preferably recessed below an upper edge of the planter box to thereby allow soil to cover the container and cover. A side wall of the planter box preferably includes a personalized inscription thereon memorializing the deceased.

In still another embodiment of the present invention, the decorative structure comprises a wind chime assembly including a plurality of chimes. The openable and closable compartment may comprise a container forming a part of an upper support from which the chimes of the assembly are suspended. Alternatively, the openable and closable compartment may comprise a container forming a part of a chime motion inducing pendulum of the wind chime assembly.

The main advantage of the present invention is that a combination lawn/garden ornament and cremation container is provided which provides a loved one of a deceased an alternative, somewhat nontraditional yet nonetheless attractive means of displaying the cremated remains of the deceased.

These and other objects and advantages of the present invention will become more readily apparent during the following detailed description taken in conjunction with the drawings herein, in which:

DETAILED DESCRIPTION OF THE INVENTION

Figure 1:
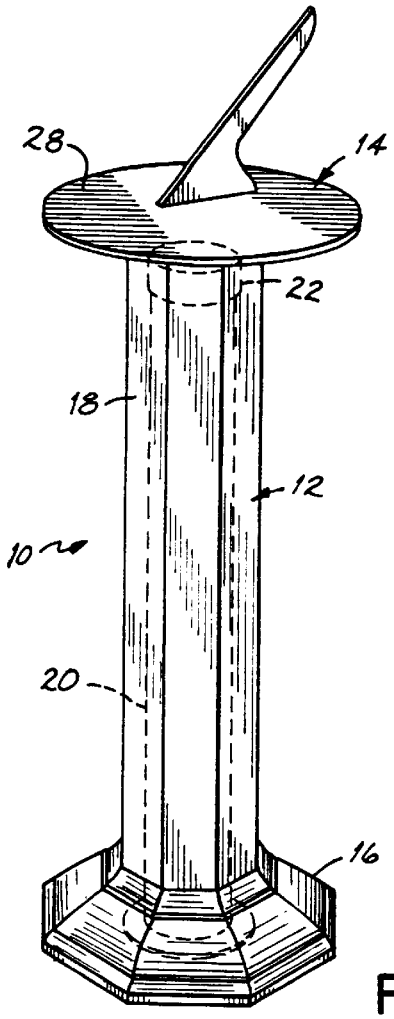
FIG. 1 is a perspective view of one embodiment of the present invention.

Referring first to FIG. 1, there is illustrated one embodiment of a combination lawn/garden ornament and cremation container of the present invention, designated generally by the numeral 10. Generally speaking, the combination lawn/garden ornament and cremation container 10 comprises a decorative structure adapted to be displayed outdoors on a lawn and/or in a garden of a loved one of a deceased, and including an openable and closeable compartment adapted to contain the cremated remains of the deceased.

Figure 2:
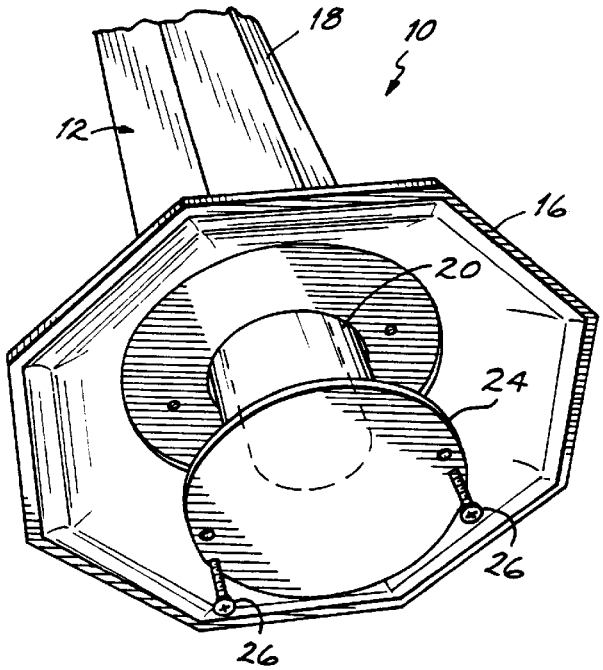
FIG. 2 is a partial bottom perspective view of the embodiment of FIG. 1.

Describing the FIG. 1 embodiment in more detail, and referring now to FIGS. 1 and 2, the combination 10 comprises a hollow pedestal 12 upon which is mounted a sundial 14. Pedestal 12 includes a base portion 16 and an upright sundial supporting portion 18. Positioned within the pedestal 12, which is hollow, is a tube 20 including a cap 22 which is removably secured on an upper end thereof. Tube 20 and cap 22 are preferably fabricated of ABS plastic. Tube 20 preferably includes a flange 24 on a lower end thereof, which flange 24 is secured to the base 16 via fasteners 26. The cap 22 is preferably a press fit on the end of the tube 20. Cremated remains of the deceased may be inserted within the tube 20, and then cap 22 placed upon the end of the tube 20. Tube 20 is then inserted into pedestal 12 and secured with the fasteners 26. If desired, the cremated remains may be encased within a plastic bag or the like prior to insertion within the tube 20. Sundial 14 preferably includes an upwardly oriented face 28 thereon suitable for inscribing thereon a personalized inscription memorializing the deceased.

Figure 3:
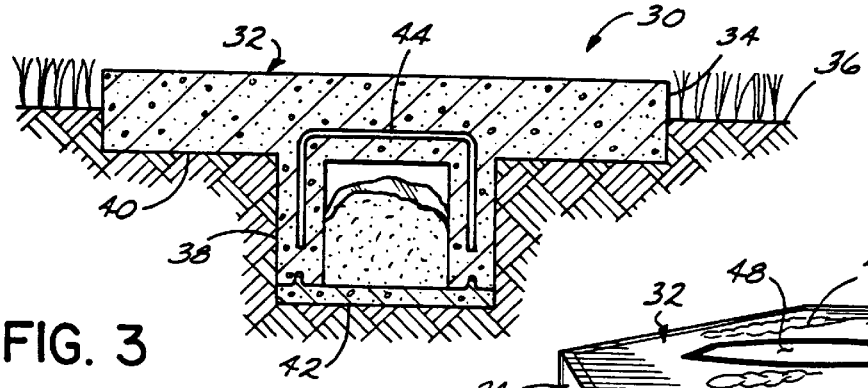
FIG. 3 is a side cross-sectional view of another embodiment of the present invention.
Figure 4:
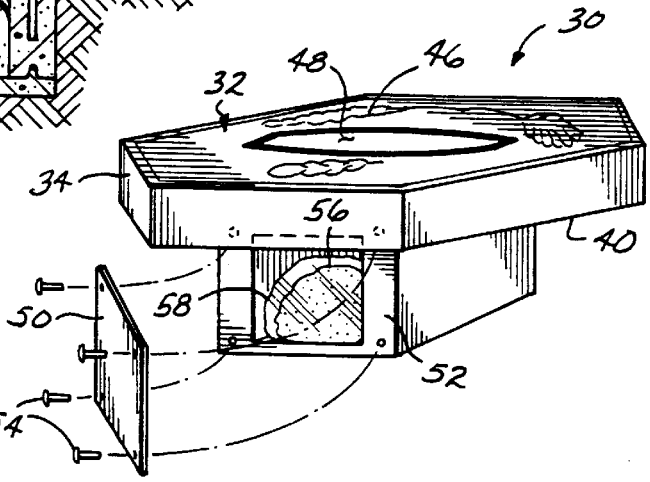
FIG. 4 is a perspective view of another version of the embodiment of FIG. 3.

Referring now to FIGS. 3 and 4, there is illustrated another embodiment 30 of the combination lawn/garden ornament and cremation container of the present invention. This embodiment 30 comprises a stepping stone 32, a portion 34 of which is adapted to be displayed above a ground surface 36. A container 38 is formed integral with the stepping stone 32, and extends downwardly from a lower surface 40 of the stepping stone 32, and includes a cover 42 which is removably secured to the container 38. Of course container 38 is adapted to be positioned below the ground surface 36, i.e. buried. The stepping stone 32 and container 38 may be fabricated of, for example, concrete and may include suitable reinforcing structure such as the rebar shown at 44. Cover 42 may be attached to container 38 with suitable fasteners and the like, and sealed with silicone caulk. Alternatively, container 38 may be fabricated of sheet metal with a peripheral flange or the like secured to surface 40 of stone 32 with suitable fasteners.

As shown in FIG. 4, the stepping stone 32 may include a decorative stained glass inlay 46 thereatop, and a central region 48 for inscribing a personalized inscription memorializing the deceased. FIG. 4 also illustrates another version of the embodiment of FIG. 3, wherein a cover member 50 is removably secured to a lateral side 52 of the container 38 via fasteners 54 or the like and of course sealed with silicone caulk or the like. As in the embodiment illustrated in FIGS. 1 and 2, ashes of a deceased 56 may be encased within a plastic bag 58 prior to insertion into the container 38.

Figure 5:
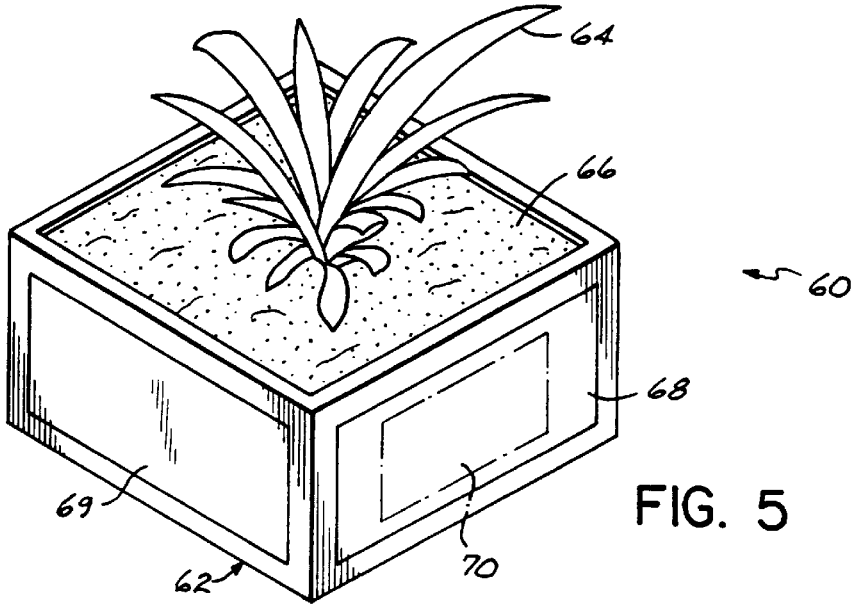
FIG. 5 is a perspective view of yet another embodiment of the present invention.
Figure 6:
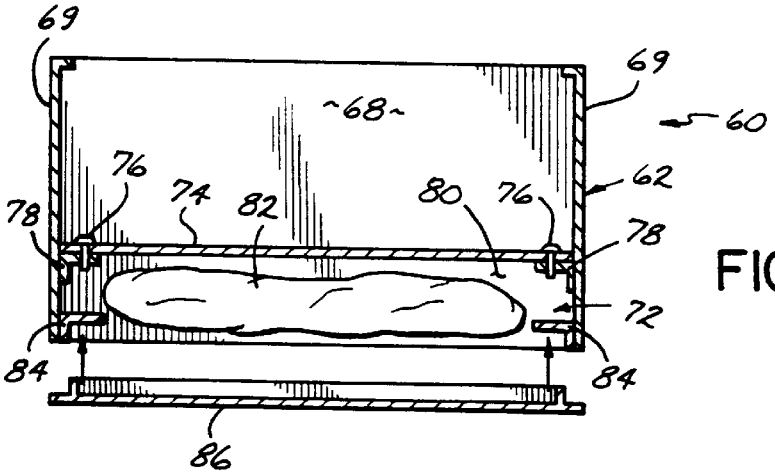
FIG. 6 is a side cross-sectional view of the embodiment of FIG. 5.
Figure 7:
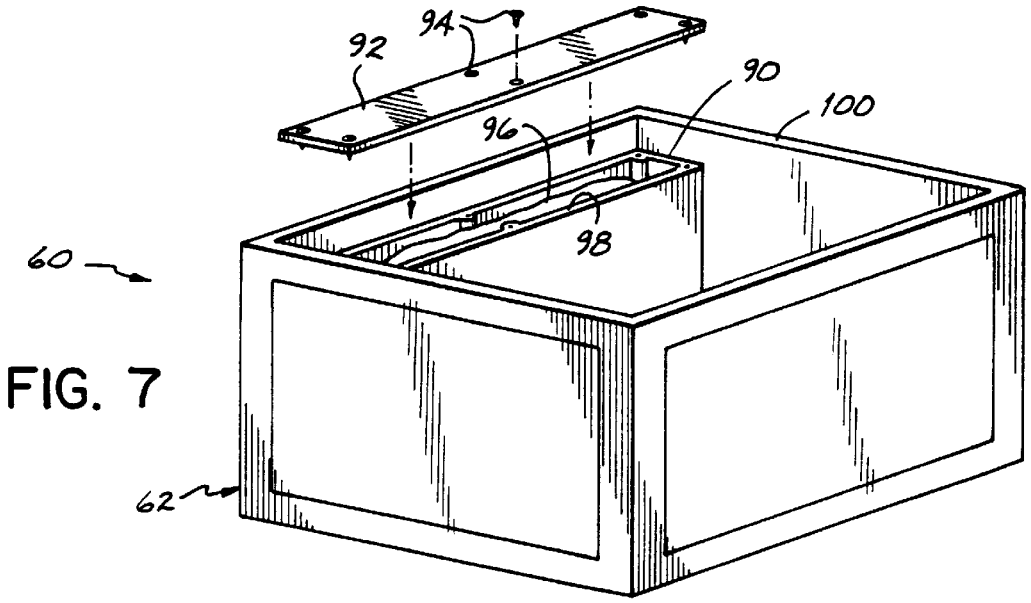
FIG. 7 is a perspective view another version of the embodiment of FIG. 5.

Referring now to FIGS. 5–7, there is illustrated yet another embodiment of the combination lawn/garden ornament and cremation container of the present invention, illustrated at 60. In this embodiment, a planter box 62 is provided for planting therein a plant as at 64 in soil as at 66 contained within the planter box 62. A side wall 68 includes an area 70 for a personalized inscription thereon memorializing the deceased. As shown in FIG. 6, a container 72 is formed in the bottom of the planter box 62. A false bottom 74 is secured by fasteners 76 to angles 78 mounted to the side walls 69 of the planter box 62. Volume 80 defined thereby is for receiving the cremated remains 82. Additional angle sections 84 are secured to the side walls 69 of the planter box 62 and are for receiving thereagainst a cover 86 attached thereto with suitable fasteners and silicone caulk.

FIG. 7 illustrates another version of the planter box of FIGS. 4 and 5, but with the container 90 formed in the side of the planter box 62. Container 90 may be a separate container which is fixed within the planter box 62 by any conventional means, or it may be integrally formed therewith. In any event, container 90 includes a cover 92 removably securable on an upper side thereof via fasteners 94 and silicone caulk and the like. Cremated remains 96 are positioned within the container 90. The upper edge 98 of the container 90 is preferably located below the upper edge 100 of the planter box 62 so that soil 66 within the planter box 62 conveniently covers the container 90 and cover 92.

Figure 8:
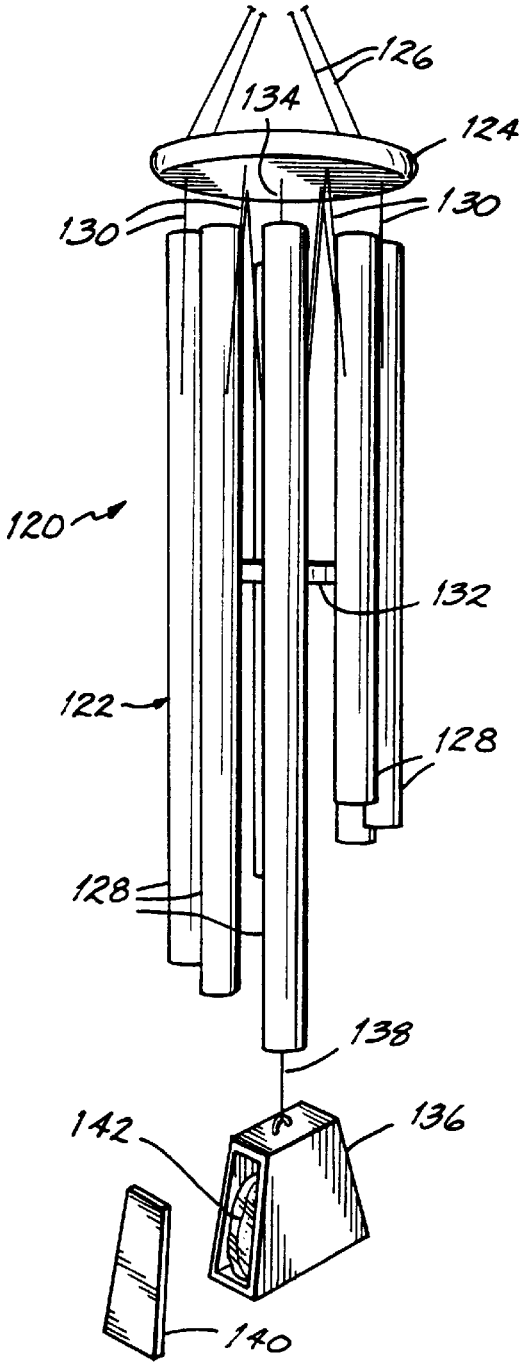
FIG. 8 is a perspective view of still another embodiment of the present invention.
Figure 9:
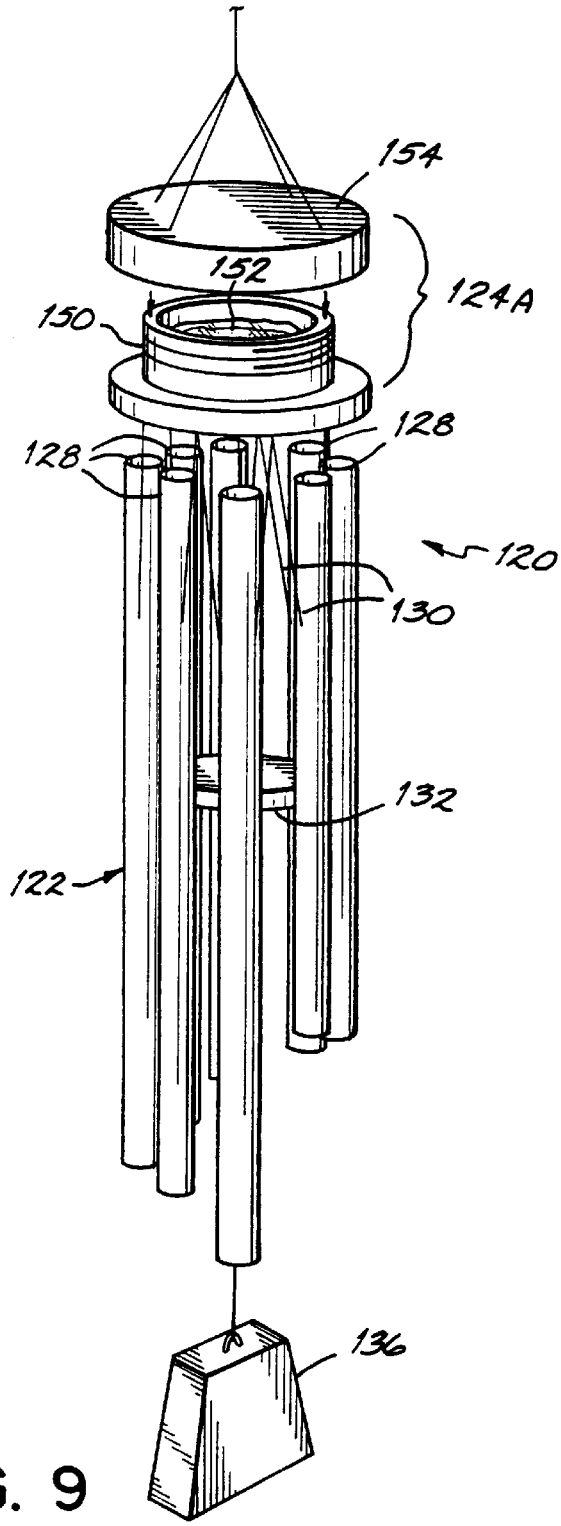
FIG. 9 is a perspective view of another version of the embodiment of FIG. 8.

FIGS. 8 and 9 illustrate yet another embodiment of the combination lawn/garden ornament and cremation container of the present invention, designated generally by the numeral 120. In these embodiments, and with like numbers representing like components, a wind chime assembly 122 comprises, generally, a wind chime support 124 which is adapted to be suspended from an eave, soffit, tree limb or the like via strandlike members 126. Suspended from the support 124 are a plurality of hollow pipes 128 or other devices which generate pleasing tones as they strike one another as during a breeze or the like. Pipes 128 are suspended from the support 124 via strandlike members 130. A central clacker 132 is suspended from support 124 via strandlike member 134 and has suspended therefrom, a chime motion-inducing pendulum 136 via strandlike member 138. In the embodiment shown in FIG. 8, the chime motion-inducing pendulum 138 includes a cover 140 removably securable thereon, for containing therein cremated remains 142. In the embodiment illustrated in FIG. 9, a modified form of the upper support, denoted by the numeral 124A, includes a hollow cylinder 150 including cremated remains 152 therein, and a cover 154 removably securable upon the cylinder 150. Cylinder 150 may, for example, be externally or internally threaded to cooperate with internal or external threads respectively of cover 154, for removably securing the cover 154 on the cylinder 150 after the remains 152 are placed therein.

The various embodiments of the present invention all provide a unique means for memorializing a loved one by providing a decorative lawn/garden ornament in conjunction with a cremation container for displaying the same on a lawn and/or in a garden of a loved one of the deceased.

A preferable form of sundial 14 of the present invention is available from Virginia Metal Crafters, Waynesboro, Va., as part Nos. 3813 or 9932. A preferable pedestal 12 is also available from Virginia Metal Crafters as part No. 3811.

Planter box 62 may preferably be of the type which is likewise available from Virginia Metal Crafters as part Nos. 9934 or 9935.

The wind chimes 120 may preferably be of the type denoted Woodstock Chimes® by Woodstock Percussion, Inc., West Hurley, N.Y.

Those skilled in the art will readily recognize numerous adaptations and modifications which can be made to the present invention which will result in an improved combination lawn/garden ornament and cremation container, yet all of which will fall within the spirit and scope of the present invention as defined in the following claims. Accordingly, the invention is to be limited only by the scope of the following claims and their equivalents.

What is claimed is:

1. A combination lawn or garden ornament comprising:

a decorative structure adapted to be displayed outdoors on a lawn or in a garden of a loved one of a deceased;

said decorative structure including an openable and closable compartment adapted to contain cremated remains of the deceased;

wherein:

said decorative structure comprises a wind chime assembly including a plurality of chimes; and said openable and closable compartment comprises a container forming a part of an upper support from which said chimes are suspended; said container comprising a hollow cylinder and a cover removably securable upon said cylinder.

2. A combination lawn or garden ornament of claim 1 wherein said cylinder and cover are matingly threaded.

3. A combination lawn or garden ornament comprising:

a decorative structure adapted to be displayed outdoors on a lawn or in a garden of a loved one of a deceased;

said decorative structure including an openable and closable compartment adapted to contain cremated remains of the deceased;

wherein:

said combination includes an upper support;

said decorative structure comprises a wind chime assembly including a plurality of chimes; and said openable and closable compartment comprises a container forming a part of a chime motion inducing pendulum of said wind chime assembly;

said pendulum being spaced from said upper support.

4. A method of memorializing a deceased comprising:

providing a combination lawn or garden ornament comprising:

a decorative structure adapted to be displayed outdoors on a lawn or in a garden of a loved one of a deceased;

said decorative structure including an openable and closable compartment adapted to contain cremated remains of the deceased;

said decorative structure comprising a wind chime assembly including a plurality of chimes; and said openable and closable compartment comprising a container forming a part of an upper support from which said chimes are suspended;

opening the compartment;

placing cremated remains of the deceased in the compartment;

closing the compartment; and displaying the structure.

5. A method of memorializing a deceased comprising:

providing a combination lawn or garden ornament comprising:

a decorative structure adapted to be displayed outdoors on a lawn or in a garden of a loved one of a deceased;

said decorative structure including an openable and closable compartment adapted to contain cremated remains of the deceased;

said combination including an upper support;

said decorative structure comprising a wind chime assemble including a plurality of chimes; and said openable and closable compartment comprising a container forming a part of a chime motion inducing pendulum of said wind chime assembly;

said pendulum being spaced from said upper support;

opening the compartment;

placing cremated remains of the deceased in the compartment;

closing the compartment; and displaying the structure.

* * * * *